US009877620B2

(12) United States Patent
Gallob

(10) Patent No.: US 9,877,620 B2
(45) Date of Patent: Jan. 30, 2018

(54) BASIN VENT

(71) Applicant: Randall Gallob, Scottsdale, AZ (US)

(72) Inventor: Randall Gallob, Scottsdale, AZ (US)

(73) Assignee: STONE AND STEEL SYSTEMS, LLC, Mesa, AZ (US)

( * ) Notice: Subject to any disclaimer, the term of this patent is extended or adjusted under 35 U.S.C. 154(b) by 0 days.

(21) Appl. No.: 14/550,323

(22) Filed: Nov. 21, 2014

(65) Prior Publication Data

US 2015/0074899 A1 Mar. 19, 2015

Related U.S. Application Data

(63) Continuation-in-part of application No. 14/208,347, filed on Mar. 13, 2014, now abandoned.

(60) Provisional application No. 61/907,295, filed on Nov. 21, 2013, provisional application No. 61/785,110, filed on Mar. 14, 2013.

(51) Int. Cl.

| | |
|---|---|
| ***E03C 1/04*** | (2006.01) |
| ***A47K 10/48*** | (2006.01) |
| ***E03C 1/186*** | (2006.01) |

(52) U.S. Cl.

CPC ..... *A47K 10/48* (2013.01); *E03C 1/0404* (2013.01); *E03C 1/186* (2013.01); *A47K 2210/00* (2013.01)

(58) Field of Classification Search

CPC ..... A47K 10/48; E03C 1/0404; E03C 1/186
USPC ..... 4/675, 680, 651
See application file for complete search history.

(56) References Cited

U.S. PATENT DOCUMENTS

| | | | | |
|---|---|---|---|---|
| 3,618,622 | A | | 11/1971 | Zien et al. |
| 4,231,123 | A | * | 11/1980 | Cheng ..... E03C 1/2306 4/519 |
| 4,373,345 | A | | 2/1983 | Tyree et al. |
| 5,086,526 | A | | 2/1992 | Van Marcke |
| 5,199,118 | A | | 4/1993 | Cole et al. |
| 5,765,242 | A | | 6/1998 | Marciano |
| 5,943,712 | A | | 8/1999 | Van Marcke |
| 5,966,753 | A | | 10/1999 | Gauthier et al. |
| 6,178,572 | B1 | | 1/2001 | Van Marcke |
| 6,549,816 | B2 | | 4/2003 | Gauthier et al. |
| 6,701,194 | B2 | | 3/2004 | Gauthier et al. |
| 7,107,631 | B2 | | 9/2006 | Lang et al. |
| D588,676 | S | | 3/2009 | Loberger et al. |

(Continued)

FOREIGN PATENT DOCUMENTS

| | | |
|---|---|---|
| GB | 2 499 215 | 8/2013 |
| JP | 05-163748 | 6/1993 |

(Continued)

OTHER PUBLICATIONS

Office Action for Canadian Application No. 2,872,011, dated Nov. 17, 2015, 3 pages.

(Continued)

*Primary Examiner* — Christine Skubinna
(74) *Attorney, Agent, or Firm* — Foley & Lardner LLP

(57) ABSTRACT

A sink system including a vent for receiving forced air into the sink from a dryer. A vent ring may be located between a sink basin and a sink deck forming the vents. The dryer may be included in a fixture housing with a faucet as a combination. The sink deck may include a vent lip that directs forced air into the vent. The vent lip extends into a basin region beyond the vent. The vent ring may be affixed to the sink deck or to the sink basin.

6 Claims, 3 Drawing Sheets

(56) References Cited

U.S. PATENT DOCUMENTS

| | | | | |
|---|---|---|---|---|
| 2005/0133100 | A1 | 6/2005 | Bolderheij et al. | |
| 2009/0000024 | A1 | 1/2009 | Louis et al. | |
| 2009/0032126 | A1 | 2/2009 | Kissel, Jr. | |
| 2009/0077736 | A1 | 3/2009 | Loberger et al. | |
| 2010/0251477 | A1* | 10/2010 | Bates | E03C 1/18 4/680 |
| 2012/0124737 | A1* | 5/2012 | Gibson | E03C 1/048 4/643 |
| 2013/0086741 | A1 | 4/2013 | Bayley et al. | |
| 2013/0199640 | A1 | 8/2013 | Williamson | |

FOREIGN PATENT DOCUMENTS

| | | |
|---|---|---|
| JP | 08-170358 | 7/1996 |
| JP | 2000-144835 | 5/2000 |
| TW | M408638 U | 8/2011 |
| WO | WO-2009/039290 | 3/2009 |
| WO | WO-2011/044247 | 4/2011 |

OTHER PUBLICATIONS

AdvocateTM Lavatory System—LA Series (LA90), Bradley Corporation, dated Oct. 20, 2010, retrieved from http://www.bradleycorp.com/productes/techdata/1068.pdf, 8 pages.

Lavatory System offers all-in-one handwashing experience, ThomasNetNews—Green & Clean, dated May 21, 2009, retrieved from http://news.thomasnet.com/fullstory/Lavatory-System-offers-all-in-one-handwashing-experience-560306, 8 pages.

Office Action on Canadian Patent Application No. 2,846,537 dated Mar. 27, 2015, 5 pages.

Office Action for Canadian Patent Application No. 2,846,537 dated Mar. 1, 2016, 4 pages.

Office Action on U.S. Appl. No. 14/208,347, dated Mar. 10, 2016, 14 pages.

Office Action for U.S. Appl. No. 14/208,347, dated Aug. 30, 2016, 16 pages.

JP 05-163748A English translation printed Aug. 23, 2016.

* cited by examiner

BASIN VENT

CROSS REFERENCE TO RELATED APPLICATIONS

This application claims priority to U.S. Prov. No. 61/907,295 filed Nov. 21, 2013, and further claims priority as a continuation-in-part of U.S. patent application Ser. No. 14/208,347, filed Mar. 13, 2014, which claims the benefit of U.S. Prov. App. No. 61/785,110, filed Mar. 14, 2013, all of which are hereby incorporated by reference.

FIELD OF THE INVENTION

The present invention generally relates drying devices and water fixtures, including but not limited to basins and sink decks.

BACKGROUND OF THE INVENTION

Applicant has previously described in U.S. Prov. App. No. 61/785,110 Faucet Dryer, hereby incorporated by reference, an automatic faucet housing with a hand dryer outlet coming out of the faucet spout. Such a device may be positioned above a sink basin such that the water and the air would be dispensed at different moments into the basin. In addition, prior installations of fixtures have included a faucet for dispensing water into a basin with an automatic dryer in proximity. One of the difficulties with such an installation is that if the separate automatic dryer (or the combination as described in the reference application) is pointed into a sink basin and activated, forced air stream causes a high pressure region within the sink basin and the air stream can deflect out of the sink bowl. The same issue can arise in situations where a special basin is provided to "catch" water from a user when they are positioned to dry their hands; i.e. the automatic dryer is above a separate basin than the basin for the excess water off the hands. With this arrangement with a high pressure air stream deflected out of a basin or catch several adverse effects can occur. The high velocity air coming out of the faucet nozzle pointed into the sink basin can be deflected off the sink basin at an angle out towards the user causing inconvenience. Also when a sink basin becomes filled with water then the water drains out of the sink, some residual water remains along the surface of the sink basin, or similarly, slow draining sinks can leave residual water present when a drying cycle occurs. When high velocity air coming out of the faucet nozzle pointed into the sink basin deflects off of the sink basin surface, the surface water that has remained on the sink basin surface can be blown out of the sink basin towards the user causing inconvenience. High velocity air traveling at an angle over the residual water in a sink basin which has no direction except back out of the sink basin towards the user. Further, this high velocity air is typically directed into the basin, which is often parabolic or hemispherical along a vector that will result in the air deflecting back out of the basin with sufficient energy to cause discomfort to a user. In some types of devices, this redirected air carries with it water that causes user inconvenience, splashing up at the user.

SUMMARY OF THE INVENTION

One embodiment relates to a sink system. The system includes a sink deck having a sink opening. A sink basin is disposed below the sink deck and defining a basin region. A portion of the sink deck forms a lip defining the sink opening. A vent ring separates a sink deck from the sink basin. The vent ring has a plurality of vent ring openings between supports. A plurality of vents are defined by the vent ring openings and one of the sink deck or the sink basin.

Another embodiment relates to a drying system which includes a sink basin defining a sink basin region and separated from a sink deck by a vent ring, the sink deck having a lip extending into the sink basin region. The vent ring has a plurality of vents. A dryer is configured to direct forced air into the sink basin. The dryer is positioned relative to the basin region and the plurality of vents such that substantially all of a forced air from the dryer is directed into one or more of the plurality of vents.

Another embodiment relates to a sink system comprising a sink deck having a sink opening. A sink basin is disposed below the sink deck and defines a basin region. A portion of the sink deck forms a lip defining the sink opening and extending into the basin region. At least one vent is positioned below the sink deck lip and has an opening into the basin region.

Additional features, advantages, and embodiments of the present disclosure may be set forth from consideration of the following detailed description, drawings, and claims. Moreover, it is to be understood that both the foregoing summary of the present disclosure and the following detailed description are exemplary and intended to provide further explanation without further limiting the scope of the present disclosure claimed.

BRIEF DESCRIPTION OF THE DRAWINGS

The foregoing and other objects, aspects, features, and advantages of the disclosure will become more apparent and better understood by referring to the following description taken in conjunction with the accompanying drawings, in which.

DETAILED DESCRIPTION OF THE PREFERRED EMBODIMENTS

Figure 1A:
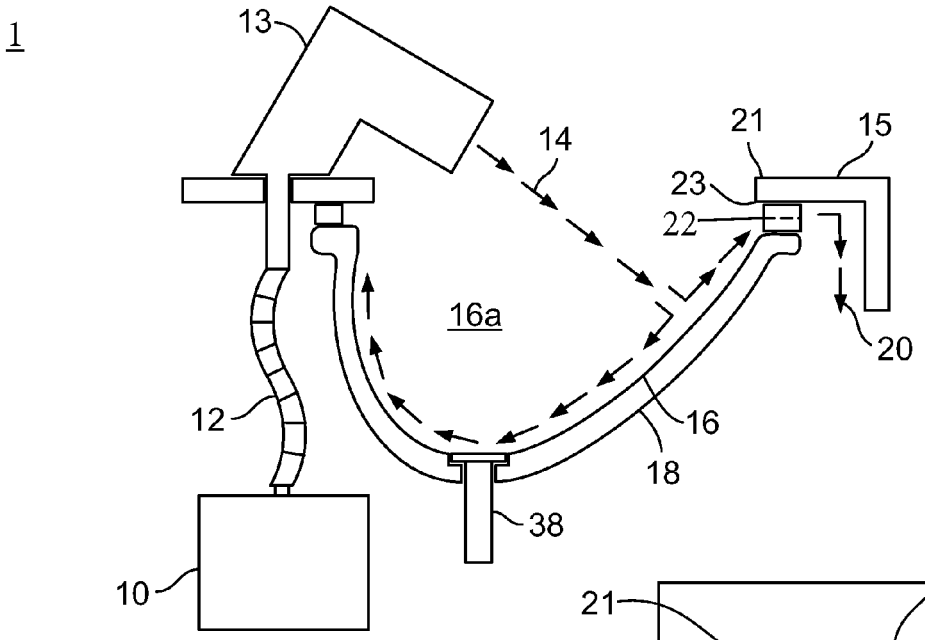
FIG. 1A depicts an under mount sink, in cross-section, which fits just under a sink deck and shows a close-up (FIG. 1B) of the vent ring in position between the sink deck and sink basin.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

One implementation comprises a sink system 1. The sink system 1 may include a vanity or other "deck" such as the sink deck 15. One implementation of the sink system 1 comprises a dryer 13. Further, a faucet 30 may be provided, as well as a drain 38. The dryer 13 provides forced air and the faucet 30 provides water. In one embodiment, the dryer 13 and faucet may 30 be provided separately from a fixture housing (not shown) or may be integrated within a single component, such as within the fixture housing 40. A housing 40 forming a dryer-faucet is further described in U.S. patent application Ser. No. 14/208,347 incorporated herein by reference.

In one embodiment, the fixture housing 40 having an inlet 42 and an outlet 43 with a passage defined there between. The housing 40 of various form factors as are known in the art. In one implementation the faucet 30 is positioned with the housing 40 extending above the sink deck 15 with the inlet 42 open to an area below the sink deck 15 and the outlet 43 positioned above the sink basin 16 such that water is dispensed into the basin region 16*a*.

A water line (not shown) extends to the faucet 30 to provide water to the faucet. In one implementation, the water line 45 enters the fixture housing 40 at the inlet 42. The faucet 30 includes a nozzle 33 which serves as the exit point from the fixture housing 40 for the water, dispensing the water into the basin region 16*a*.

A forced air system 50, comprises dryer 13, a blower 10 and a forced air line 12, such as a duct or plenum. The blower 10 provides forced air directed to the dryer 13 by the air line 12. The dryer 13 includes an exhaust 54 from which the forced air exits the dryer 13.

As described above, the use of a dryer 13 directed to a basin 16 to allow for collection of water from a user (such as their hands) as the dryer 13 blows results in inconvenience caused by a forced air stream 14 pointing into a sink basin 16. This forced air stream 14 is typically deflected towards a user due to the shape of the sink basin 16 and typical location of the fittings on the rear of the basin. With respect to FIG. 1, by introducing a basin vent 22, for example a vent lip 21 and/or a vent ring 19, along all or a part of the edge of the sink basin 16, a forced air stream 14 blowing into a sink basin 16 can be deflected out of the sink basin region 16*a* and underneath the sink deck 15, away from the user rather than deflected upwards into a user. In one implementation, the basin vent 22 introduces a fixed surface area all along the top of the sink basin 16 where forced air stream 14, for example high velocity and/or heated air, is redirected away from a user, such as a passageway to escape the sink basin 16 and not be deflected back out at the user.

In one implementation, the vent lip 21 has flow through passages and a small catching edge 23 and with the vents 22 allows the high velocity air 14 to be diverted out of the sink basin 16. In one implementation, the vent lip 21 is cast as part of the sink basin 16. In an alternative implementation, the vent lip 21 is a separate component engageable with the sink deck 15. The vent lip 21 has a circumference (though it need not be circular nor have the exact shape of the basin 16) that is slightly less than the sink basin 16. Thus, the sink basin 16 terminates "under" the sink deck 15 such that there is an area, the vent lip 21, of the sink deck 15 that is exposed about the inner perimeter of the basin 16. This vent lip 21 protrudes into the basin 16 provide a protruding edge 23. In one implementation, the vent lip 21 protrudes sufficiently to prevent the forced air stream 14 from escaping the basin 16, for example ½ inch past the vents 22. In essence, it is believed that the lip 21 acts as an air dam to stop the air stream 14 as well as water from escaping the basin 16 upwards, such as towards a user or above the deck 15. Rather, in certain implementations the air stream 14 is deflected back towards the basin 16 by the vent lip 21.

Figure 1B:
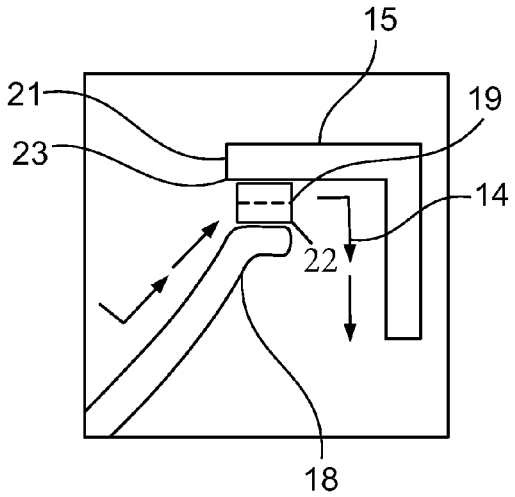
FIG. 1C shows the individual Vent ring as installed onto such a plumbing arrangement.
Figure 2A:
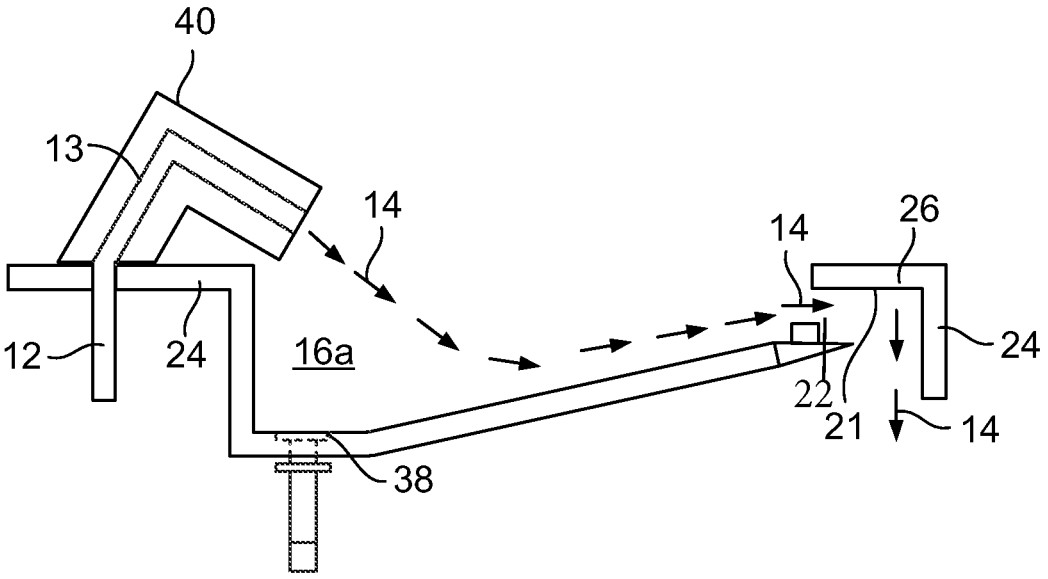
FIG. 2A depicts a solid surface integrated sink system showing a molded or fabricated vent ridge along the front of the sink system.
Figure 2B:
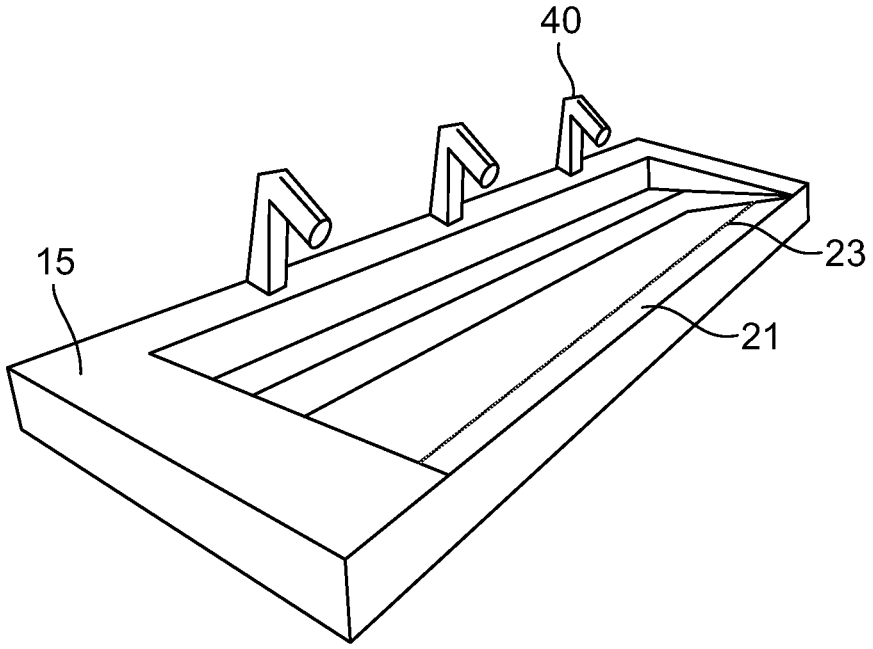
FIG. 2B shows a typical commercial integrated sink system.

In one implementation, a vent ring 19 is utilized to allow the high velocity air 14 to be diverted from the sink basin 16 away from the user. The vent ring 19 can, in one implementation, be an integral part of the sink basin 16. In an alternative implementation, the vent ring 19 is an integral part of the sink deck 15. Further, where the vent ring 19 is a separate component it may be removably affixed to one of the sink basin 16 or the sink deck 15 and permanently affixed to the other. In a further implementation, the vent ring 19 is a separate component allowing for a "retrofit" of an existing installation. In this embodiment, the separate piece of the vent ring 19 is assembled in between the sink deck 15 and the basin 16 (for example, a "under mount sink"). The vent ring 19 may have substantially the shape of the sink basin 16, the vent ring 19 may be elliptical. Further, in certain embodiments the vent ring 19 is not elliptical but rather includes a first end and a second end and does not extend around the entire sink basin, for example as shown in FIG. 2A-B. IN one embodiment, as shown in FIG. 1B, the vent ring 19 includes a plurality of openings 11 formed between supports 9. The openings 11 form, in conjunction with either the sink basin 16 or the sink deck 15, the vents 22. In one embodiment, the openings 11 are located in a portion of the vent ring 19, for example in a 120 degree arc portion, as the forced air is only directed to this area of the sink system 1. In an alternative embodiment, the openings 11 are disposed about the entire vent ring 19.

Figure 3:
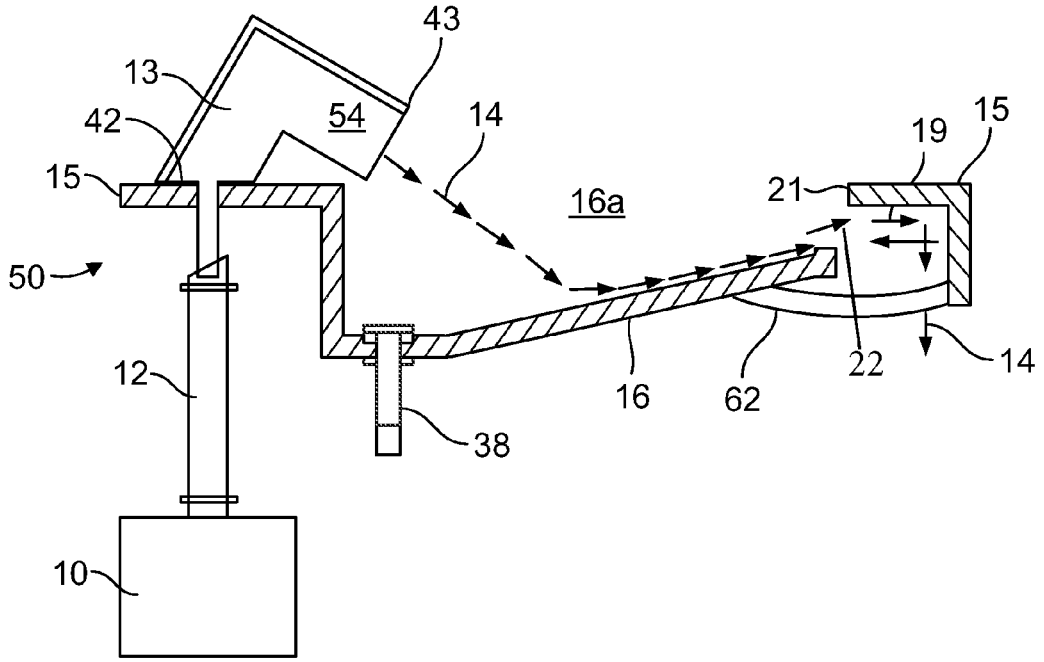
FIG. 3 depicts a basin which might have the vent ring molded into the fixture as cast or as a separate mounting ring.
Figure 4A:
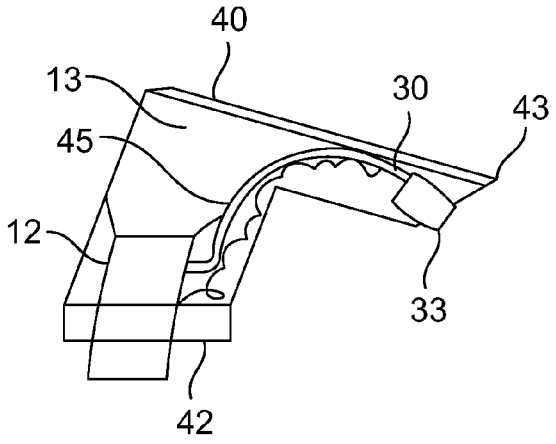
FIG. 4A is a cross-sectional view of the side view.
Figure 4B:
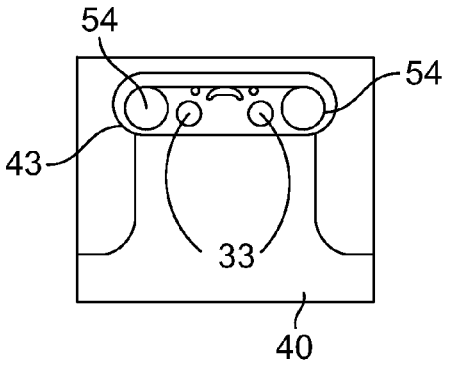
FIG. 4B is front view of a faucet-dryer outlet.

In one embodiment, no vent ring 19 is utilized, rather the vent 22 is formed by a gap between the lip 21 and the sink basin 16, as shown in FIG. 3. A trap 62 may be utilized to provide a trap or filter in the vent 22.

In a preferred embodiment, the forced air 14, or substantially all that continues to move with sufficient velocity, is directed into the vent 22.

In one implementation, along the circumference of the vent ring 19 are one or more openings 11 to the outside of the sink basin 16 (for example, exposing the area under the sink deck 15 outside of the basin 16). In a further implementation, the vent lip 21 has an edge 23 that redirects the high velocity air and divert out of the sink basin 16. The one or more openings 11 may be spaced about the vent ring 19 (for example, evenly disbursed about the vent ring 19). Further, the one or more openings 11 may be an opening such as a hole or passage in the ring 19 or may be an entire void within the ring 19 (essentially breaking the continuity of the ring 19, such that the ring 19 comprises more than one physical component) or result from the absence of the ring 19 and be formed between the sink deck 15 and the sink basin 16.

In one embodiment, a user uses the automatic faucet/dryer 13 by washing their hands underneath the outlet exhaust 54 of a dryer 13, which, in one embodiment is mounted to an undermounted sink 18 (FIG. 1) having the sink basin 16 or a sink deck 15. Inside the outlet 43 of the fixture housing 40 is the exhaust 54 for the dryer 13, exhausting forced air 14 which comes from the blower 10 through a forced air line 12 out through the faucet/dryer exhaust 54. It should be appreciated the forced air 14 may be exhausted from a separate dryer 13 or a dryer 13 included together with a faucet 30 within the fixture housing 40. At the end of the washing sequence, water flow stops and high velocity air 14 blows out of the exhaust 54 onto a user's wet hands blowing off the water while the hands are still within the sink basin 16. This is much the same routine a user follows when they place their hands under a commercial hand dryer in a public restroom which is mounted along a wall away from the washing sink basin 16, causing water to be blown to the floor. The forced air stream 14 blows down along the bottom contour of the sink basin 16 and gets redirected upward deflecting off the lip 21 and the air flows out beyond the vent 22 so as to not inconvenience the user with air (or water) blowing up towards their frontal position.

Figure 1C:
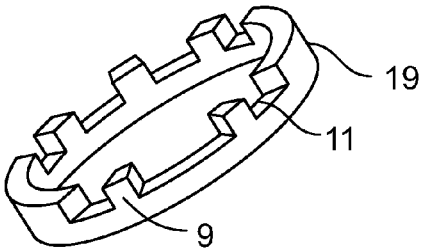

This diversion of high velocity air and water which otherwise would deflect up towards the standing user is redirected to a lower pressure region by virtue of the vent ring 19. As the high velocity drying air blows over the hands, some of the air hits areas at the bottom of the sink basin 16. As shown in FIG. 1, the undermount sink 18 is mounted to the underside of the sink deck 15 and the circular vent ring 19 is interposed in between the sink 18 and the sink deck 15. Along the edges of the circular vent ring 19 are openings 11 which can be of various configurations. The circular vent ring 19 is mounted such that a lip 21 is formed on the underside of the sink deck 15. For example, the circumference of the opening in the sink deck 15 for the basin 16 is less than the circumference for the vent ring 19, with the overhanging or extending portion corresponding to the lip 21.

In an alternate embodiment, best shown in FIG. 2A the circular vent ring can be linear vent lip 21 all along the inside front of a typical commercial integrated sink 24. In this application the vent lip 21 also forms the edge 23 on the lip inside of the sink basin 16. In similar fashion an undermount lavatory sink, a user uses the automatic faucet/dryer 13 by washing their hands underneath the outlet nozzle which is mounted to an integrated sink deck 24. Inside the outlet nozzle is an exhaust port for the high velocity hand drying air which comes through a forced air line 12 out through the faucet/dryer fitting exhaust 54. At the end of the washing sequence with no water flow, high velocity air 14 blows out of the outlet nozzle onto a user's wet hands and blows off the water while the hands are still within the sink basin 16 and detection zone. On some integrated sink 24 the high velocity hand dryer air deflects off the bottom of the sink basin 16 and off the lip 21 and out towards the outside of the sink basin 16 as shown in FIG. 2A.

In a similar method, the high velocity hand dryer air 14 is redirected to a lower pressure zone and does not inconvenience user with deflected high velocity hand dryer air 14 up towards the user.

In yet another implementation, the actual lip 21 and ring 19 is cast into a sink basin 16, FIG. 3 depicting a cross section. For example, the openings 11 of the vent ring 19 can be molded within vitreous china forming the sink basin 16 so that the high velocity air flow 14 channels itself out of the sink basin 16. Thus, in certain implementations the ring 19 is a unitary portion of the sink basin 16.

In an alternative embodiment the vent ring 19 can be located along the front edge of a longitudinal sink deck 15, solid surface integrated sink system In this embodiment with a sink deck 15 the vent lip 21 can be molded into a front lip of the sink deck assembly. With this embodiment, when the forced air stream 14 blows into the sink deck 15, the molded in vent lip 21 will allow the air to escape out of the sink area and not back up towards the user. The molded intermittent holes 22 in the vent ring 19 open to the outside of the sink deck 15 area allowing the forced air stream 14 to escape the sink area.

In one embodiment, a basin vent may be utilized without an associated faucet or soap dispenser. For example, in one embodiment a basin 16 includes a high velocity blower 10 producing the air stream 14 but no associated faucet. Such a faucet-less basin may be utilized alone or in combination with the basin's 16 having a faucet associated therewith. In a particular embodiment, this faucet-less basin is positioned closer to the edge of the deck 15, such as for ease of reach for a user in front of a sink.

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

I claim:

1. A drying system a sink basin defining a sink basin region and separated from a sink deck by a vent ring, the sink deck having a lip extending at least ½ inch into the sink basin region;

the vent ring having a vent with an associated opening, the lip positioned above the vent, the opening exposed to the sink basin region and to an area underneath the sink deck and outside of the sink basin;

a dryer configured to direct forced air through a dryer exhaust port into the sink basin;

the dryer is positioned relative to the basin region and the vent such that substantially all of the forced air from the dryer is directed through the dryer exhaust port into the sink basin region and then into the vent.

2. The drying system of claim 1, wherein the vent ring is a linear vent ridge and the vent opening is positioned substantially opposite the dryer.

3. The drying system of claim 1, further comprising a faucet.

4. The drying system of claim 1, wherein the faucet and dryer are disposed within a spout.

5. The drying system of claim 1 further comprising a blower positioned in communication with the dryer exhaust port.

6. The drying system of claim 5, wherein the blower is positioned below the sink deck and in communication with the dryer exhaust port via a duct.

* * * * *